US009283783B2

(12) United States Patent
Yoda et al.

(10) Patent No.: US 9,283,783 B2
(45) Date of Patent: Mar. 15, 2016

(54) RECORDING APPARATUS

(71) Applicant: SEIKO EPSON CORPORATION, Tokyo (JP)

(72) Inventors: Hiroyuki Yoda, Shiojiri (JP); Masanori Nakata, Matsumoto (JP); Takeshi Aoki, Matsumoto (JP); Toshikazu Kotaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/645,277

(22) Filed: Mar. 11, 2015

(65) Prior Publication Data

US 2015/0258816 A1 Sep. 17, 2015

(30) Foreign Application Priority Data

Mar. 12, 2014 (JP) ..... 2014-48774

(51) Int. Cl.
*B41J 2/01* (2006.01)
*B41J 13/10* (2006.01)

(52) U.S. Cl.
CPC ..... *B41J 13/103* (2013.01)

(58) Field of Classification Search
CPC ..... B41J 11/007; B41J 11/06; B41J 11/0085; B41J 13/103; B41J 11/0065
USPC ..... 347/104, 101
See application file for complete search history.

(56) References Cited

U.S. PATENT DOCUMENTS

| | | | | |
|---|---|---|---|---|
| 5,725,207 | A * | 3/1998 | Deguchi | 271/9.09 |
| D526,351 | S * | 8/2006 | Yamamoto et al. | D18/55 |
| 7,894,097 | B2 | 2/2011 | Naruse | |
| 8,155,556 | B2 | 4/2012 | Moribe et al. | |
| 2006/0210337 | A1 * | 9/2006 | Nagata et al. | 399/407 |
| 2007/0291056 | A1 * | 12/2007 | Tanahashi et al. | 347/8 |

FOREIGN PATENT DOCUMENTS

JP 02-286546 11/1990

* cited by examiner

*Primary Examiner* — Manish S Shah
*Assistant Examiner* — Yaovi Ameh
(74) *Attorney, Agent, or Firm* — Workman Nydegger

(57) ABSTRACT

A recording apparatus includes a body, an operation panel provided on a front surface of the body, a feeding cassette that accommodates sheets, removably mounted with respect to the body from the front surface of the body, and is configured such that a part thereof is protruded from body in a state of being mounted on the body, a recording section that is disposed inside the body and performs printing by ejecting ink onto a sheet transported from the feeding cassette, a discharging tray that is disposed on the feeding cassette and supports the sheet after printing is completed, and a body-side cover section that is provided in the body and covers both side surfaces of the feeding cassette. Then, when viewed from a right and left direction, a first farthest section that is positioned in the farthest position from the body in the feeding cassette in a front direction is separated from the body in the front direction further than a second farthest section that is positioned in the farthest position from the body in the operation panel in the front direction.

6 Claims, 2 Drawing Sheets

RECORDING APPARATUS

BACKGROUND

1. Technical Field

The present invention relates to a recording apparatus, for example, such as an ink jet type printer.

2. Related Art

In the related art, as a type of a recording apparatus, an ink jet type printer that performs printing (recording) by ejecting ink (liquid) from a printing head (recording section) onto a sheet to be fed from a sheet cassette (medium accommodation body) is known. In such printers, there is a printer in which a sheet cassette is mounted on a body so as to protrude from the body (for example, see JP-A-2-286546).

However, in the printer disclosed in JP-A-2-286546, since the sheet cassette having a relatively low rigidity is exposed from the body, there is a problem that the rigidity of the sheet cassette is insufficient.

SUMMARY

An advantage of some aspects of the invention is to provide a recording apparatus capable of ensuring rigidity of a medium accommodation body.

Hereinafter, means of the invention and operation effects thereof will be described.

According to an aspect of the invention, a recording apparatus includes a body; an operation section that is provided in one side portion of the body; a medium accommodation body which accommodates a medium, is removably mounted on the body from one side portion in which the operation section is provided in the body, and of which a part is protruded from the body in a state of being mounted on the body; a recording section that is disposed in the body and performs recording by ejecting a liquid onto the medium transported from the medium accommodation body; a medium support section that is disposed on the medium accommodation body and supports the medium after recording is performed by the recording section; and a body-side cover section that is provided in the body and covers both side portions of the medium accommodation body. A first farthest section that is positioned in the farthest position from the body in the medium accommodation body in a protrusion direction is separated from the body in the protrusion direction further than a second farthest section that is positioned in the farthest position from the body in the operation section in the protrusion direction when viewed from a side orthogonal to the protrusion direction in which the medium accommodation body protrudes from the body.

In this case, since both of the side portions of the medium accommodation body having a relatively low rigidity are protected by being covered by the body-side cover section, it is possible to ensure the rigidity of the medium accommodation body.

In the recording apparatus, it is preferable that a medium support surface that is a surface on which the medium is supported in the medium support section serves as the medium support surface when manually feeding the medium into the body, and a discharging transportation path in which the medium is transported to the medium support section after recording is performed by the recording section is positioned in a position higher than a feeding transportation path of the medium when manually feeding the medium from the medium support surface into the body.

In this case, since the discharging transportation path is positioned in the position higher than that of the feeding transportation path, it is possible to separate the medium that is discharged to the medium support surface and the medium that is manually fed from the medium support surface into the body.

In recording apparatus, it is preferable that the medium support section is rotatably configured and is positioned by a lower portion thereof coming into contact with an upper portion of the medium accommodation body in a state of being mounted on the body.

In this case, since the rotatable medium support section is supported from below by the medium accommodation body, it is possible to increase the rigidity of the medium support section.

In recording apparatus, it is preferable that the medium support section has the medium support surface that is a surface on which the medium is supported, and the medium support surface is inclined so as to rise in a discharge direction in which the medium is discharged to the medium support surface in a state where the positioning of the medium support section is performed.

In this case, since the medium support surface is inclined so as to rise in the discharge direction in a state where positioning of the medium support section is performed, it is possible to increase holding performance of the medium in the medium support surface.

In the recording apparatus, it is preferable that the medium support section is a pull-out type and support the medium in a state of not being protruded from the first farthest section in the protrusion direction, in a case where the medium is an A4 size sheet or a letter size sheet, and medium is discharged to the medium support section in a direction in which a long side thereof is orthogonal to the discharge direction in which the medium is discharged to the medium support section.

In this case, since the medium support section supports the medium without protruding from the first farthest section of the medium accommodation body in the protrusion direction in a case where the sheet of the A4 size or the sheet of the letter size which are relatively frequently used are horizontally discharged to the medium support section, it is possible to use the medium support section in a state of having a high rigidity.

In the recording apparatus, it is preferable that an extension unit having an extension medium accommodation body is removably mounted on a lower side of the body, the extension unit has an extension-side cover section that covers both side portions of the extension medium accommodation body, and the extension-side cover section and the body-side cover section are configured to be continuous in a state where the extension unit is mounted on the body.

In this case, since the both side portions of the extension medium accommodation body having a relatively low rigidity are protected by being covered by the extension-side cover section and the extension-side cover section and the body-side cover section are continuous if the extension unit is mounted on the body, it is possible to ensure the rigidity as a whole.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a recording apparatus will be described with reference to the drawings.

Figure 1:
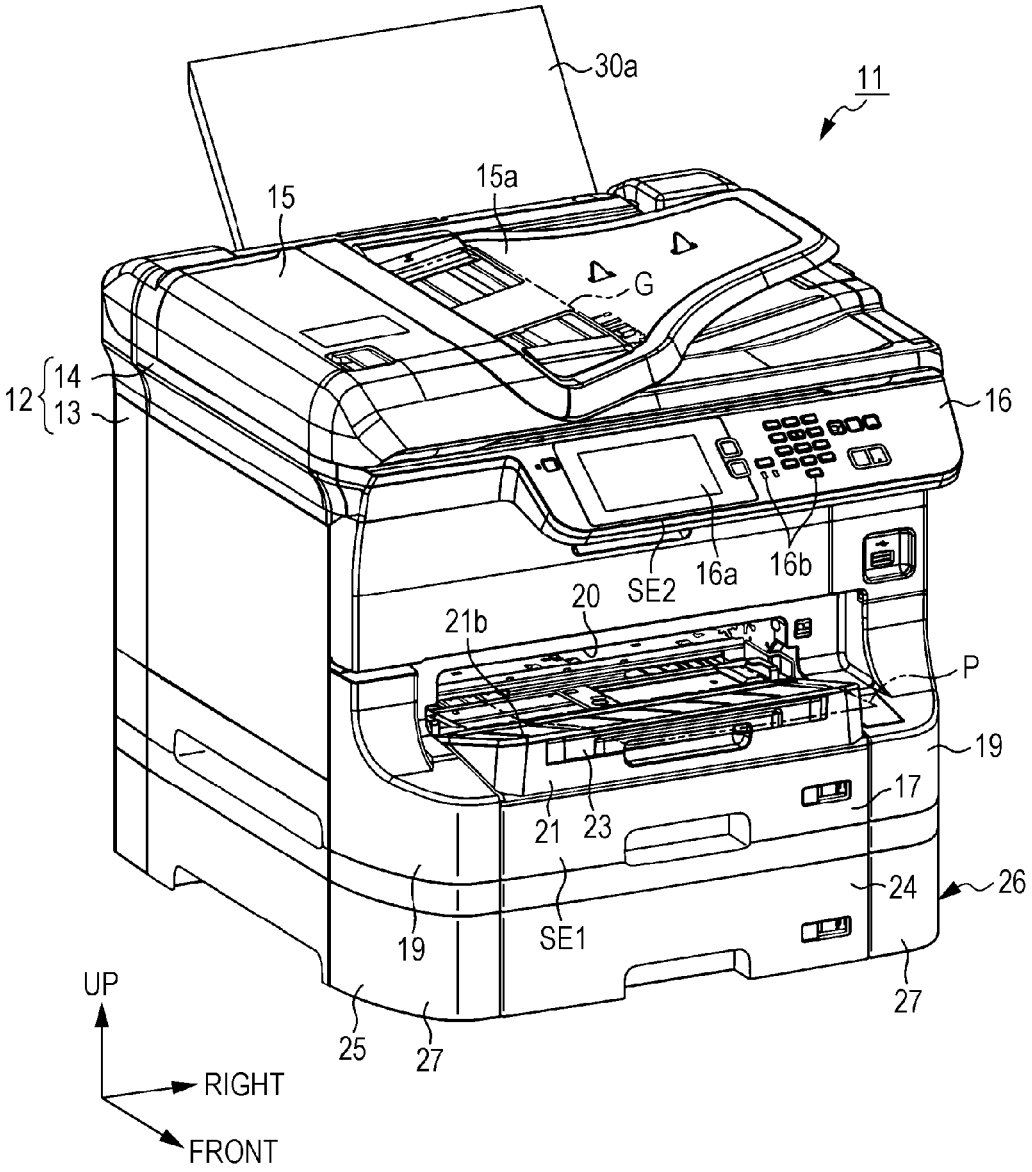
FIG. 1 is a perspective view of a recording apparatus in one embodiment.

As illustrated in FIG. 1, a recording apparatus 11 includes a body 12 forming a substantially rectangular parallelepiped shape as a whole. The body 12 includes a printer section 13 that performs printing (recording) on a sheet P as an example of a medium and a scanner section 14 that is provided on the printer section 13 and is capable of reading a document G and the like. An automatic document feeding section 15 is provided on the scanner section 14. The automatic document feeding section 15 automatically feeds one or a plurality of documents G set on a document setting section 15*a* to the scanner section 14.

The automatic document feeding section 15 is configured so as to be opened and closed with respect to the scanner section 14 and is opened when the document G is jammed and the like. The scanner section 14 reads the document G fed by the automatic document feeding section 15. The printer section 13 performs printing by ejecting ink that is an example of a liquid onto the sheet P based on image data of the document G read by the scanner section 14. The scanner section 14 is configured to be opened and closed with respect to the printer section 13 and is opened when the sheet P is jammed and the like.

Figure 2:
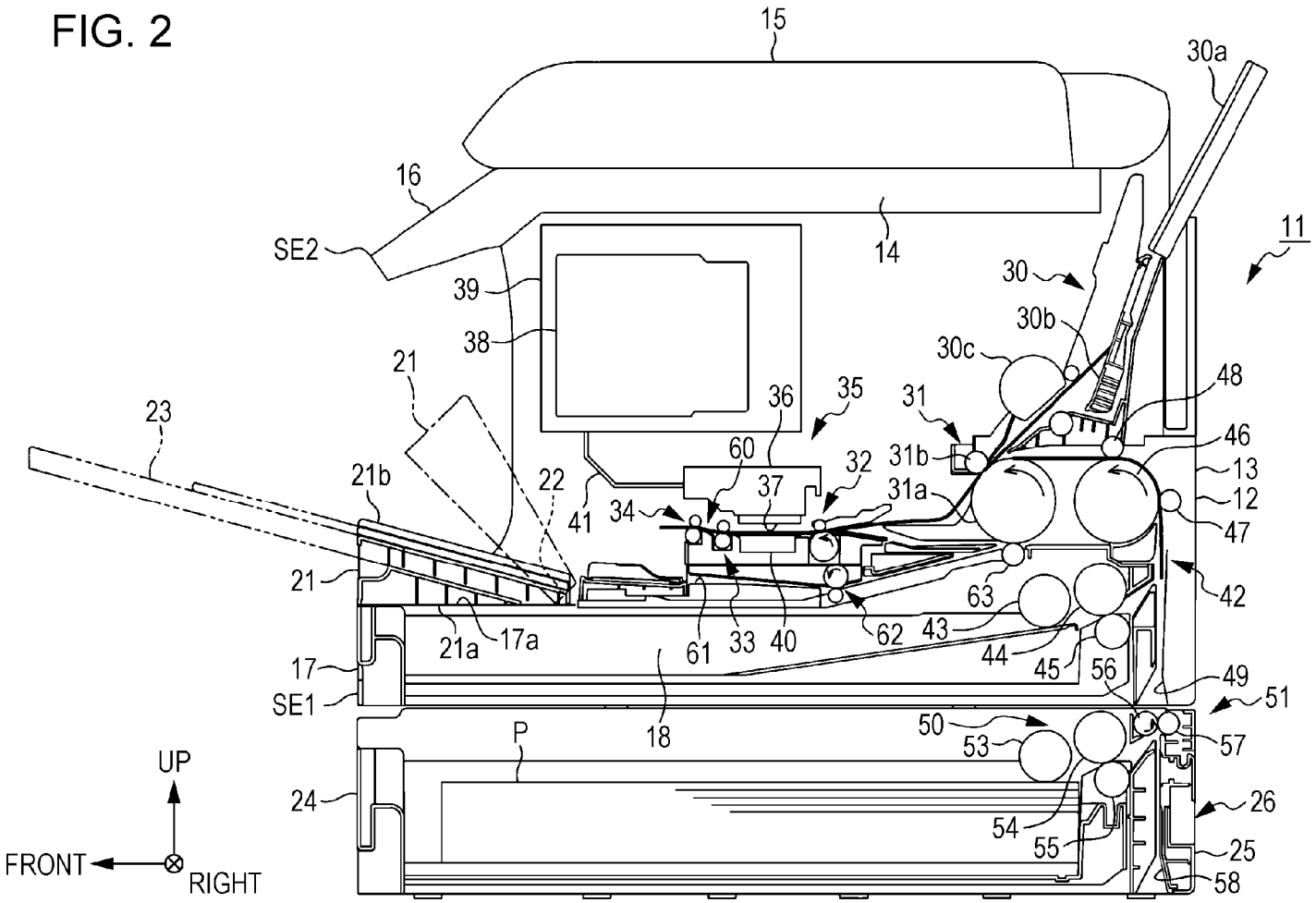
FIG. 2 is a schematic side cross-sectional view of the recording apparatus.

As illustrated in FIGS. 1 and 2, an operation panel 16 forming a substantially rectangular shape as an example of an operation section for performing various operations of the recording apparatus 11 is provided on a front surface (one side portion of the body 12) of the scanner section 14 so as to obliquely protrude downward on a front side. A long side of the operation panel 16 extends in a right-left direction and the operation panel 16 extends over a position slightly closer to a left end portion (other end portion) than a center portion from a right end portion (one end portion) in the front surface of the scanner section 14 in the right-left direction.

Thus, a length of the front surface of the scanner section 14 in the right-left direction is longer than that of the operation panel 16 and the left end portion (other end portion) in the front surface of the scanner section 14 is a portion in which the operation panel 16 does not exist. A display section 16*a* displaying a menu screen and the like, and various operation buttons 16*b*, or the like are disposed in the operation panel 16. Then, the farthest position from the scanner section 14 (body 12) in the operation panel 16 in a front direction is a second farthest section SE2.

A cassette mounting section 18 on which a feeding cassette 17 having a rectangular parallelepiped shape as an example of a medium accommodation body accommodating a plurality of sheets P in a stacked state is removably mounted is provided in a lower end portion of the printer section 13. In this case, the feeding cassette 17 is removably mounted on the cassette mounting section 18 from the front surface (one side portion of the body 12) of the printer section 13 in a front-rear direction.

Then, in a state where the feeding cassette 17 is mounted on the cassette mounting section 18, a part of the feeding cassette 17 protrudes forward from the front surface of the printer section 13. Thus, in the embodiment, a protrusion direction that is a direction in which a part of the feeding cassette 17 protrudes from the front surface of the printer section 13 matches the front direction. Furthermore, in the embodiment, an up-down direction orthogonal to the front direction matches a vertical direction.

Body-side cover sections 19 covering both right and left side surfaces of a portion that protrudes from the printer section 13 in the feeding cassette 17 are respectively provided on both sides over the feeding cassette 17 in the front surface of the printer section 13 in the right-left direction. Each of body-side cover sections 19 is integrally formed with the printer section 13. In this case, one of two body-side cover sections 19 is disposed in one end portion in the front surface of the printer section 13 in the right-left direction and the other side is disposed in the other end portion in the front surface of the printer section 13 in the right-left direction.

The farthest position from the printer section 13 (body 12) in the feeding cassette 17 in the front direction is a first farthest section SE1. That is, in the embodiment, the front surface of the feeding cassette 17 is the first farthest section SE1. Then, the front surface (first farthest section SE1) of the feeding cassette 17 and the front surface of each body-side cover section 19 are flush with each other.

Furthermore, the first farthest section SE1 of the feeding cassette 17 is separated from the front surface of the body 12 in the front direction further than the second farthest section SE2 of the operation panel 16 when viewed from a side (right and left direction) orthogonal to both the front direction (protruding direction) and the up-down direction (vertical direction). That is, the first farthest section SE1 is positioned on the front side further than the second farthest section SE2.

As illustrated in FIGS. 1 and 2, an opening section 20 through which the sheet P is manually fed into the printer section 13 or the sheet P after printing is performed inside the printer section 13 is discharged to the outside of the printer section 13 is formed just above the feeding cassette 17 in the front surface of the printer section 13. Furthermore, a discharging tray 21 as an example of a medium support section supporting the sheet P is provided in the front surface of the printer section 13, which is rotatably provided about a shaft 22 extending in the right-left direction so as to protrude forward from the lower end portion of the opening section 20. As illustrated by one-dotted chain line in FIG. 2, the discharging tray 21 is configured so as to be rotated by lifting.

The discharging tray 21 forms a wedge shape (substantially triangular shape) viewed from the right-left direction. That is, a thickness of the discharging tray 21 is thicker going forward. A planar lower surface 21*a* (lower portion) of the discharging tray 21 comes into contact with a horizontal upper surface 17*a* (upper portion) of the feeding cassette 17 in a state where the feeding cassette 17 is mounted on the cassette mounting section 18 and thereby the discharging tray 21 is positioned about the shaft 22 in a rotation direction. That is, the discharging tray 21 is disposed on the feeding cassette 17 in a state where the feeding cassette 17 is mounted on the cassette mounting section 18.

An upper surface 21*b* of the discharging tray 21 configures a medium support surface on which the sheet P is supported. That is, the upper surface 21*b* of the discharging tray 21 serves as the medium support surface on which the sheet P discharged from the opening section 20 after printing is performed is supported and the medium support surface on which the unprinted sheet P is supported when manually feeding the sheet P from the opening section 20 into the printer section 13.

The upper surface 21*b* of the discharging tray 21 is inclined with respect to a horizontal surface in a state where the discharging tray 21 is positioned by the feeding cassette 17. That is, in a state where the discharging tray 21 is positioned by the feeding cassette 17, the upper surface 21*b* of the discharging tray 21 is inclined so as to rise in a discharge direction (front direction) in which the sheet P after printing is performed inside the printer section 13 is discharged from the opening section 20 to the upper surface 21*b* of the discharging tray 21. Moreover, the front surface of the discharging tray 21 and the front surface of the feeding cassette 17 are flush with each other in a state where the discharging tray 21 is positioned by the feeding cassette 17.

Furthermore, as illustrated by a two-dotted chain line in FIG. 2, the discharging tray 21 of the embodiment employs a pull-out type having a pull-out section 23 capable of extending a length in the front direction by being pulled out in the front direction. Furthermore, the discharging tray 21 is configured to support the sheet P in a state of not protruding from the first farthest section SE1 of the feeding cassette 17 in the front direction, if the sheet P is an A4 size or a letter size and the sheet P is discharged to the discharging tray 21 horizontally in which a long side of the sheet P is orthogonal to the discharge direction (front direction) in which the sheet P is discharged to the discharging tray 21.

That is, in the discharging tray 21, an area of the upper surface 21*b* is set so as to enable supporting of the sheet P without pulling out the pull-out section 23 if the sheet P of the A4 size or the letter size is horizontally discharged to the discharging tray 21. Moreover, a space is formed between the discharging tray 21 and the operation panel 16 in the vertical direction.

As illustrated in FIGS. 1 and 2, an extension unit 26 having an extension feeding cassette 24 as an example of an extension medium accommodation body capable of accommodating a plurality of sheets P in a state where the sheets P are in a stacked state, and an extension cassette mounting section 25 on which the extension feeding cassette 24 is removably mounted are removably mounted on the lower surface of the printer section 13 (body 12). The extension unit 26 is configured so that an entirety of the extension feeding cassette 24 is overlapped with an entirety of the feeding cassette 17 in the vertical direction in a state of being mounted on the lower surface of the printer section 13.

The extension cassette mounting section 25 includes extension-side cover sections 27 covering both right and left side surfaces of the extension feeding cassette 24 in a state where the extension feeding cassette 24 is mounted on the extension cassette mounting section 25. That is, the extension-side cover sections 27 are respectively disposed on both sides over the extension feeding cassette 24 in the right-left direction. Then, each extension-side cover section 27 and each body-side cover section 19 are continuous with each other in the vertical direction in a state where the extension feeding cassette 24 is mounted on the extension cassette mounting section 25 of the extension unit 26 mounted on the lower surface of the printer section 13.

The front surface of the extension feeding cassette 24 in a state of being mounted on the extension cassette mounting section 25 is respectively flush with the front surface of the feeding cassette 17 in a state of being mounted on the cassette mounting section 18, the front surface of each body-side cover section 19, and the front surface of each extension-side cover section 27. Furthermore, both right and left side surfaces and a rear surface of the extension unit 26 are flush with the both right and left side surfaces and a rear surface of the printer section 13.

As illustrated in FIGS. 1 and 2, a feeding section (auto sheet feeder) capable of automatically feeding the sheet P is provided in an upper portion of a rear end in the printer section 13. The feeding section 30 includes a tray 30*a* on which the sheet P is set, a hopper 30*b*, and a feeding roller 30*c*. The sheet P set on the tray 30*a* is pressed against the feeding roller 30*c* by an operation of the hopper 30*b* and is delivered on a downstream side of a transportation path by rotation of the feeding roller 30*c*.

A pair of transportation rollers 31 and 32, and a pair of discharging rollers 33 and 34 which transport the sheet P from the feeding section 30 to the discharging tray 21 are disposed inside the printer section 13 along the transportation path. A recording section 35 performing printing (recording) on the sheet P is disposed in a position between the transportation roller pair 32 and the discharging roller pair 33.

The recording section 35 is disposed in an upper position facing the transportation path of a portion between the transportation roller pair 32 and the discharging roller pair 33 and includes a carriage 36 capable of reciprocating in the right-left direction that is a scanning direction (direction orthogonal to a paper surface in FIG. 2) orthogonal to the front direction that is the transportation direction and a recording head 37 provided in a lower portion of the carriage 36.

A cartridge holder 39 on which an ink cartridge 38 accommodating the ink is removably mounted is disposed above the recording section 35 inside the printer section 13. Furthermore, the recording section 35 includes a support stand 40 that supports the sheet P in a lower portion facing a moving region of the recording head 37. Then, the recording head 37 performs printing of an image and the like on the sheet P by ejecting the ink supplied from the ink cartridge 38 through a tube 41 onto a portion of the sheet P that is supported on the support stand 40.

Moreover, a portion on the downstream side (discharging tray 21 side) further than the recording section 35 in the transportation path of the sheet P is a discharging transportation path 60 on which the sheet P after printing is performed by the recording section 35 is transported to the discharging tray 21.

A supply section 42 that delivers the sheet P accommodated in the feeding cassette 17 to the recording section 35 one by one in the feeding path is provided in the lower portion of a rear end inside the printer section 13. The supply section 42 includes a pick-up roller 43 coming into contact with the uppermost sheet of a plurality of sheets P inside the feeding cassette 17, a separation roller 44, and a retard roller 45 that forms a pair with the separation roller 44.

Furthermore, the supply section 42 includes an intermediate roller 46 that is discharged on a rear side of the transportation roller pair 31 and two driven rollers 47 and 48 pinching the sheet P with the intermediate roller 46. The transportation roller pair 31 includes an intermediate roller 31*a* that is driven to rotate in conjunction with the intermediate roller 46 and a driven roller 31*b* that forms a pair with the intermediate roller 31*a*.

Then, when the pick-up roller 43, the separation roller 44, and the intermediate rollers 46 and 31*a* are rotated by power of a motor (not illustrated) provided in the body 12 in a counter-clockwise direction in FIG. 2, the sheets P accommodated in the feeding cassette 17 are fed one by one to the recording section 35 through the transportation rollers 31 and 32. Moreover, a feeding path 49 that is a road through which the sheet P fed from the extension unit 26 passes is formed in the lower portion of the rear end inside the printer section 13 so as to extend upward from a bottom portion of the printer section 13.

The extension unit 26 includes a feeding mechanism 50 that feeds the plurality of sheets P accommodated in the extension feeding cassette 24 in a stacked state one by one and a transportation mechanism 51 that transports the sheet P fed by the feeding mechanism 50. The feeding mechanism 50 and the transportation mechanism 51 are driven by a motor (not illustrated) provided in the extension unit 26.

The feeding mechanism 50 includes a pick-up roller 53 coming into contact with the uppermost sheet P inside the extension feeding cassette 24, a feeding roller 54 feeding the sheet P to the transportation mechanism 51, and a retard roller 55 that forms a pair with the feeding roller 54. The transportation mechanism 51 includes a transportation roller 56 and a driven roller 57 that forms a pair with the transportation roller 56.

Then, if a motor (not illustrated) is driven to rotate and then the pick-up roller 53, the feeding roller 54, and the transportation roller 56 are rotated in the counter-clockwise direction in FIG. 2, the sheets P accommodated in the extension feeding cassette 24 are fed toward the feeding path 49 of the body 12 one by one. In this case, the retard roller 55 has a function for separating only the uppermost sheet P from a lower sheet group if the pick-up roller 53 feeds the plurality of sheets P.

Moreover, if a separate extension unit is extended on a lower side of the extension unit 26, a feeding path 58 that is a road through which the sheet P fed from the separate extension unit passes is formed below the transportation roller 56 and the driven roller 57 inside the extension unit 26 so as to extend upward from the bottom portion of the extension unit 26.

Furthermore, a feeding transportation path 61 that feeds the sheet P manually inserted into the printer section 13 from the upper surface 21*b* of the discharging tray 21 to the intermediate roller 31*a* is provided between the support stand 40 and the feeding cassette 17 inside the printer section 13. Thus, the discharging transportation path 60 is positioned in a position higher than the feeding transportation path 61. A pair of transportation rollers 62 that transports the sheet P to the intermediate roller 31*a* side that is the rear side is disposed in the feeding transportation path 61. A driven roller 63 pinching the sheet P with the intermediate roller 31*a* is provided on a lower side of the intermediate roller 31*a*.

Next, an operation of the recording apparatus 11 will be described.

Printing of Sheet P of Feeding Cassette 17

When printing on the sheet P accommodated in the feeding cassette 17, first, the pick-up roller 43, the separation roller 44, and the intermediate rollers 46 and 31*a* are driven to rotate in the counter-clockwise direction in FIG. 2. Then, the sheets P accommodated in the feeding cassette 17 are transported to the downstream side along the transportation path one by one and are inverted in a process of being transported while being pinched between the intermediate roller 46 and the driven rollers 47 and 48. Thereafter, the sheet P is fed to the support stand 40 while being pinched between the pair of transportation rollers 31 and 32.

The printing is performed by ejecting the ink from the recording head 37 reciprocating in the right-left direction with the carriage 36 onto the sheet P fed to the support stand 40. Then, the sheet P on which the printing is completed is transported along the discharging transportation path 60 while being pinched between the discharging rollers 33 and 34 and is discharged on the upper surface 21*b* of the discharging tray 21.

At this time, since the upper surface 21*b* is inclined so as to rise in the front direction that is the discharge direction of the sheet P, the discharging tray 21 stably receives and holds the discharged sheet P. In this case, when the sheet P of the A4 size or the sheet P of the letter size which are relatively frequently used (orientation of the long side of the sheet P is orthogonal to the discharge direction) is horizontally discharged, the discharging tray 21 can support the sheets P without pulling out the pull-out section 23.

That is, since the discharging tray 21 supports the sheets P without protruding from the first farthest section SE1 of the feeding cassette 17 in the discharge direction of the sheet P, it is possible to use the discharging tray 21 in a state of having a high rigidity. Moreover, when discharging the sheet P of the A4 size or the sheet P of the letter size vertically (orientation of the long side of the sheet P is along the discharge direction), or when discharging the sheet P (for example, the sheet P of a A3 size) of a size greater than these sheets P, the discharging tray 21 is used in a state where the pull-out section 23 is pulled out (state illustrated by the two-dotted chain line in FIG. 2).

Printing of Sheet P of Extension Feeding Cassette 24

When printing the sheet P accommodated in the extension feeding cassette 24, first, the pick-up roller 53, the feeding roller 54, the transportation roller 56, and the intermediate rollers 46 and 31*a* are driven to rotate in the counter-clockwise direction in FIG. 2. Then, the sheets P accommodated in the extension feeding cassette 24 are transported to the downstream side along the transportation path including the feeding path 49 one by one and are inverted in a process of being transported while being pinched between the intermediate roller 46 and the driven rollers 47 and 48. Thereafter, the sheet P is printed similar to in a case of the printing of the sheet P in the feeding cassette 17 described above and the same effects are obtained.

Printing of Sheet P Set in Tray 30*a*

When printing the sheet P set in the tray 30*a*, first, the sheet P is pressed against the feeding roller 30*c* by operating the hopper 30*b*. In this state, when rotating the feeding roller 30*c* in the clockwise direction in FIG. 2, the sheet P is delivered to the pair of transportation rollers 31 positioned on the downstream side of the transportation path. The delivered sheet P is fed on the support stand 40 while being pinched between the transportation rollers 31 and 32 by rotating the pair of transportation rollers 31 and 32. Thereafter, the sheet P is printed similar to in a case of the printing of the sheet P in the feeding cassette 17 described above and the same effects are obtained.

Printing of Sheet P Manually Fed from Upper Surface 21*b* of Discharging Tray 21

When printing the sheet P manually fed from the upper surface 21*b* of the discharging tray 21, first, in a state where the pair of transportation rollers 62 and the intermediate rollers 46 and 31*a* are rotated, the sheet P is inserted from the opening section 20 into the feeding transportation path 61. Then, the sheet P is transported to the intermediate roller 31*a* while being pinched by the pair of transportation rollers 62 and then is transported to the intermediate roller 46 while being pinched between the intermediate roller 31*a* and the driven roller 63.

Subsequently, after the sheets P are inverted in the process of being transported while being pinched between the intermediate roller 46 and the driven rollers 47 and 48, the sheet P is fed on the support stand 40 while being pinched by the pair of transportation rollers 31 and 32. Printing is performed on the sheet P fed on the support stand 40 by ejecting the ink from the recording head 37 reciprocating in the right-left direction with the carriage 36. Then, the sheet P on which the printing is completed is transported along the discharging transportation path 60 while being pinched by the pair of discharging rollers 33 and 34 and is discharged on the upper surface 21*b* of the discharging tray 21.

At this time, since the discharging transportation path 60 is positioned in a position higher than that of the feeding transportation path 61, the sheet P fed from the upper surface 21*b* of the discharging tray 21 and the sheet P discharged to the upper surface 21*b* of the discharging tray 21 vertically pass by each other, thereby easily being separated. Thus, the feeding of the sheet P from the upper surface 21*b* of the discharging tray 21 and the discharging of the sheet P to the upper surface 21*b* of the discharging tray 21 are smoothly performed.

As described above, according to the embodiment, it is possible to obtain the following effects.

(1) The body-side cover sections 19 that cover both right and left side surfaces of the portion protruding from the printer section 13 in the feeding cassette 17 are respectively provided on both sides over the feeding cassette 17 in the front surface of the printer section 13 in the right-left direction. Thus, since the both right and left side surfaces of the feeding cassette 17 having a relatively low rigidity can be protected by being respectively covered by the body-side cover sections 19, it is possible to ensure the rigidity of the feeding cassette 17. Particularly, in the embodiment, since the first farthest section SE1 of the feeding cassette 17 is separated from the body 12 in the front direction further than the second farthest section SE2 of the operation panel 16 when viewed in the right-left direction, it is possible to effectively ensure the rigidity of the feeding cassette 17 that is likely to be insufficient.

(2) Since the discharging transportation path 60 is positioned in the position higher than that of the feeding transportation path 61, it is possible to easily separate the sheet P fed from the upper surface 21*b* of the discharging tray 21 and the sheet P discharged to the upper surface 21*b* of the discharging tray 21 which are vertically passed by each other. Thus, it is possible to smoothly perform the feeding of the sheet P by manually feeding from the upper surface 21*b* of the discharging tray 21 and the discharging of the sheet P to the upper surface 21*b* of the discharging tray 21.

(3) Since the discharging tray 21 that is vertically rotatable can be positioned by the feeding cassette 17 by being supported from below, it is possible to increase the rigidity of the discharging tray 21.

(4) Since the upper surface 21*b* is inclined so as to rise in the discharge direction of the sheet P in a state where the positioning of the discharging tray 21 is performed, it is possible to increase the holding performance of the sheet P in the upper surface 21*b*.

(5) When the sheet P of the A4 size or the sheet P of the letter size which are relatively frequently used is horizontally discharged to the discharging tray 21, it is possible to support the sheet P by the discharging tray 21 without protruding the discharging tray 21 from the first farthest section SE1 of the feeding cassette 17 in the front direction (the discharging tray 21 does not pull out the pull-out section 23). That is, when the sheet P of the A4 size or the sheet P of the letter size is horizontally discharged to the discharging tray 21, it is possible to use the discharging tray 21 with a high rigidity in a state in which the pull-out section 23 is not pulled out.

(6) The extension unit 26 has the extension-side cover sections 27 covering both right and left side surfaces of the extension feeding cassette 24 and each extension-side cover section 27 and each body-side cover section 19 are configured so as to be continuous with each other in the vertical direction in a state where the extension unit 26 is mounted on the lower surface of the printer section 13. Thus, if the extension unit 26 is mounted on the lower surface of the printer section 13, it is possible to protect the both right and left side surfaces of the extension feeding cassette 24 having a relatively low rigidity by being covered by the extension-side cover section 27. In addition, since each extension-side cover section 27 and each body-side cover section 19 are continuous with each other in the vertical direction, it is possible to ensure the rigidity of the recording apparatus 11 as a whole.

(7) Since a space is formed between the discharging tray 21 and the operation panel 16 in the vertical direction, it is possible to easily extract the sheet P on which the printing is completed and which is discharged to the discharging tray 21.

Modification Examples

Moreover, the embodiment described above may be modified as follows.

The extension unit 26 may be omitted.

The extension unit 26 may be removably mounted with respect to the body 12 by stacking two or more.

It is not necessary for the discharging tray 21 to be the pull-out type. That is, the pull-out section 23 may be omitted.

When the sheet P of the A4 size or the sheet P of the letter size is horizontally discharged to the discharging tray 21 by pulling out the pull-out section 23, the discharging tray 21 may support the sheet P in the front direction in a state where the discharging tray 21 is protruded from the first farthest section SE1 of the feeding cassette 17.

In a state where the positioning of the discharging tray 21 is performed, it is not necessary to incline the upper surface 21*b* so as to rise in the discharge direction of the sheet P. That is, in a state where the positioning of the discharging tray 21 is performed, the upper surface 21*b* may be horizontal.

It is not necessary to rotatably configure the discharging tray 21.

It is not necessary to position the discharging tray 21 by coming into contact with the feeding cassette 17.

It is not necessary to configure the upper surface 21*b* of the discharging tray 21 so as to serve as the medium support surface supporting the sheet P after the printing is performed which is discharged from the opening section 20 and the medium support surface supporting the unprinted sheet P when being manually fed from the opening section 20 into the printer section 13.

It is not necessary to position the discharging transportation path 60 in the position higher than that of the feeding transportation path 61. That is, the discharging transportation path 60 may be disposed in a position lower than that of the feeding transportation path 61.

When printing the sheet P manually fed from the upper surface 21*b* of the discharging tray 21, one sheet P may be inserted from the opening section 20 into the feeding transportation path 61 and the plurality of sheets P may be inserted one by one.

The operation panel 16 may be fixed so as to be flush with the front surface of the body 12.

The operation panel 16 may be rotatably provided about an axis extending in the right-left direction with respect to the front surface of the body 12. In this case, when rotating the operation panel 16 in a rotatable range, the farthest position from the front surface of the body 12 in the operation panel 16 in the front direction is the second farthest section SE2.

Each body-side cover section 19 is configured separately from the printer section 13 (the body 12) and each body-side cover section 19 may be fixed to the printer section 13 using a fixing member such as a screw or adhesive.

When the sheet P of the A4 size or the letter size is horizontally discharged to the discharging tray 21, if the sheet P can be stably supported by the discharging tray 21, the sheet P may be supported by the discharging tray 21 in a state where a part of the sheet P is protruded from the first farthest section SE1 of the feeding cassette 17 in the front direction.

When discharging the sheet P on which the printing is completed to the upper surface 21*b* of the discharging tray 21 while the unprinted sheet P that is manually fed abuts the pair of transportation rollers 62 on the downstream side of the feeding transportation path 61, the unprinted sheet P and the sheet P on which the printing is completed are overlapped on the upper surface 21*b* of the discharging tray 21. In this state, if the size and the orientation of the unprinted sheet P and the sheet P on which the printing is completed are the same as each other, the position of the front end of the sheet P on which the printing is completed may be positioned on the front side further than the position of the front end of the unprinted sheet P. Thus, since the position of the sheet P on which the printing is completed and which is disposed on the upper surface 21*b* of the discharging tray 21 and the position of the unprinted sheet P that is fed can be different from each other, it is possible to further easily separate the sheet P on which the printing is completed and the unprinted sheet P.

The medium may be not only the sheet P but also cloth, plastic film, and the like.

In the embodiment described above, the recording apparatus 11 may be a liquid (including liquid, a liquid-like body that is formed by dispersing or mixing particles of a functional material to the liquid, a fluid-like body such as gel, and a solid that can be ejected to flow as a liquid) ejecting apparatus that performs recording by ejecting or discharging a fluid other than the ink. For example, the recording apparatus 11 may be a liquid-like body ejecting apparatus that performs recording by ejecting a liquid-like body contained in a form of dispersing or dissolving a material such as an electrode material or a color material (pixel material) used for manufacturing liquid crystal display, electroluminescence (EL) display, and surface emission display. Furthermore, the recording apparatus 11 may be a fluid-like body ejecting apparatus that ejects a fluid-like body such as gel (for example, physical gel). Then, it is possible to apply the invention to any one type of these fluid ejecting apparatuses. Moreover, the term "fluid" described in the specification is a concept that does not contain a fluid composed of only gas and, for example, the fluid includes liquid (including inorganic solvent, organic solvent, solution, liquid resin, liquid metal (melt metal), and the like), a liquid-like body, a fluid-like body, and the like.

The entire disclosure of Japanese Patent Application No. 2014-48774, filed Mar. 12, 2014 is expressly incorporated by reference herein.

What is claimed is:

1. A recording apparatus comprising:

a body;

an operation section that is provided in one side portion of the body;

a medium accommodation body which accommodates a medium, is removably mounted on the body from one side portion in which the operation section is provided in the body, and of which a part is protruded from the body in a state of being mounted on the body;

a recording section that is disposed in the body and performs recording by ejecting a liquid on the medium transported from the medium accommodation body;

a wedge-shaped medium support section that is disposed on the medium accommodation body and supports the medium after recording is performed by the recording section, a lower portion of the medium support section comes into contact with an upper portion of the medium accommodation body, an upper surface of the medium support section is inclined so as to rise in a discharge direction in which the medium is discharged from the recording section; and a body-side cover section that is provided in the body and covers both side portions of the medium accommodation body, wherein a first farthest section that is positioned in the farthest position from the body in the medium accommodation body in a protrusion direction is separated from the body in the protrusion direction further than a second farthest section that is positioned in the farthest position from the body in the operation section in the protrusion direction when viewed from a side orthogonal to the protrusion direction in which the medium accommodation body protrudes from the body, wherein the medium support section is rotatably configured and is positioned by a lower portion thereof coming into contact with the upper portion of the medium accommodation body in a state of being mounted on the body.

2. The recording apparatus according to claim 1, wherein a medium support surface that is a surface on which the medium is supported in the medium support section serves as the medium support surface when manually feeding the medium into the body, and wherein a discharging transportation path in which the medium is transported to the medium support section after recording is performed by the recording section is positioned in a position higher than a feeding transportation path of the medium when manually feeding the medium from the medium support surface into the body.

3. The recording apparatus according to claim 1, wherein the medium support section has the medium support surface that is a surface on which the medium is supported, and wherein the medium support surface is inclined so as to rise in a discharge direction in which the medium is discharged to the medium support surface in a state where the positioning of the medium support section is performed.

4. The recording apparatus according to claim 1, wherein the medium support section is a pull-out type and supports the medium in a state of not being protruded from the first farthest section in the protrusion direction, in a case where the medium is an A4 size sheet or a letter size sheet, and the medium is discharged to the medium support section in a direction in which a long side thereof is orthogonal to the discharge direction in which the medium is discharged to the medium support section.

5. The recording apparatus according to claim 1, wherein an extension unit having an extension medium accommodation body is removably mounted on a lower side of the body, wherein the extension unit has an extension-side cover section that covers both side portions of the extension medium accommodation body, and wherein the extension-side cover section and the body-side cover section are configured to be continuous in a state where the extension unit is mounted on the body.

6. A recording apparatus comprising:

a body;

an operation section that is provided in a side portion of the body;

a cassette mounting section that is provided in the side portion of the body, and is positioned lower than the operation section;

a feeding cassette which accommodates a medium, is removably mounted on the cassette mounting section, and of which a part is protruded from the cassette mounting section in a state of being mounted on the cassette mounting section;

a recording section that is disposed in the body and performs recording by ejecting a liquid on the medium transported from the feeding cassette;

a wedged-shaped discharging tray that is disposed on the feeding cassette and supports the medium after recording is performed by the recording section, a lower portion of the discharging tray comes into contact with an upper portion of the feeding cassette, an upper surface of the discharging tray is inclined so as to rise in a discharge direction in which the medium is discharged from the recording section; and a body-side cover section that is constituted as a portion of the body and covers both side portions of the feeding cassette, wherein a first farthest section that is positioned in the farthest position from the body in the feeding cassette in a protrusion direction is separated from the body in the protrusion direction further than a second farthest section that is positioned in the farthest position from the body in the operation section in the protrusion direction when viewed from a side orthogonal to the protrusion direction in which the feeding cassette protrudes from the cassette mounting section, wherein the discharging tray is rotatably configured and is positioned by a lower portion thereof coming into contact with the upper portion of the feeding cassette in a state of being mounted on the body.

* * * * *